US007367689B2

(12) United States Patent
Huang

(10) Patent No.: US 7,367,689 B2
(45) Date of Patent: May 6, 2008

(54) ADJUSTABLE WORKING LIGHT WITH MAGNET

(75) Inventor: Tony Huang, Taichung (TW)

(73) Assignee: Hiever Co., Ltd., Taichung (TW)

( * ) Notice: Subject to any disclaimer, the term of this patent is extended or adjusted under 35 U.S.C. 154(b) by 0 days.

(21) Appl. No.: 11/273,017

(22) Filed: Nov. 15, 2005

(65) Prior Publication Data

US 2007/0086192 A1 Apr. 19, 2007

(51) Int. Cl.
*F21V 21/26* (2006.01)

(52) U.S. Cl. ..... 362/269; 362/171; 362/287; 362/282; 362/184; 362/185; 362/186; 362/190; 362/191; 362/376; 362/399

(58) Field of Classification Search ..... 362/269, 362/171, 173, 287, 282
See application file for complete search history.

(56) References Cited

U.S. PATENT DOCUMENTS 5,765,941 A * 6/1998 Vest ..... 362/260
6,984,054 B2 * 1/2006 Lai ..... 362/199
2004/0218384 A1 * 11/2004 Newton et al. ..... 362/183
2006/0034091 A1 * 2/2006 Kovacik et al. ..... 362/398

* cited by examiner

*Primary Examiner*—Sandra O'Shea
*Assistant Examiner*—Jessica L McMillan
(74) *Attorney, Agent, or Firm*—Browdy and Neimark

(57) ABSTRACT

An adjustable light includes a base member, which is a shell-like member, having a circuit board and a battery set therein and having a pivot portion and a magnet at an end thereof. The base member can be attracted on a surface, which is made of a magnetic attraction material, by the magnet. A pivot base is pivoted on pivot portion of the base member, on which a switch is provided. An illuminating tube member has a transparent tube and a lamp in the tube. The tube has two lids to close two ends thereof. A shaft is inserted through one lid to pivot the illuminating tube member on the pivot base, and a hook mount is pivoted on the other lid.

3 Claims, 7 Drawing Sheets

ADJUSTABLE WORKING LIGHT WITH MAGNET

BACKGROUND OF THE INVENTION

1. Field of the Invention

The present invention relates to an auxiliary light for work, and more particularly to an adjustable working light, which has magnet for easy operation and movable mounting.

2. Description of the Related Art

In the work of repairing automobile or machines, worker always hold a light to illuminate the region that he/she has to work on. The light is hung on a place when the work needs both hands to work. The hung light swings or is unstable or is too fixed to adjust or rotate that the light is hard to change the illuminating direction and region. Such lights usually are used in the repairing workplace, and they are hard to be used in other place. This restricts the application range of the light.

The present inventor ever created an adjustable light to fix above problem. The light, as shown in FIG. 7 and FIG. 8, includes a main member 1, a transparent tube 2 pivoted on a front of the main member 1, in which a reflective film 3 and a lamp 4 are provided, and a hook assembly 5. The light can be hung easily in any workplace. The transparent tube 2 may be turned to any desired angle to change the illuminating direction. However, such light still needs to improve.

SUMMARY OF THE INVENTION

The primary objective of the present invention is to provide an adjustable light with magnet, which is easy to operate, move and mount.

According to the objective of the present invention, an adjustable light comprises a base member, which is a shell-like member, having a circuit board and a battery set therein and having a pivot portion and a magnet at an end thereof. The base member can be attracted on a surface, which is made of a magnetic attraction material, by the magnet. A pivot base is pivoted on pivot portion of the base member, on which a switch is provided. An illuminating tube member has a transparent tube and a lamp in the tube. The tube has two lids to close two ends thereof. A shaft is inserted through one lid to pivot the illuminating tube member on the pivot base, and a hook mount is pivoted on the other lid.

DETAILED DESCRIPTION OF THE INVENTION

Figure 1:
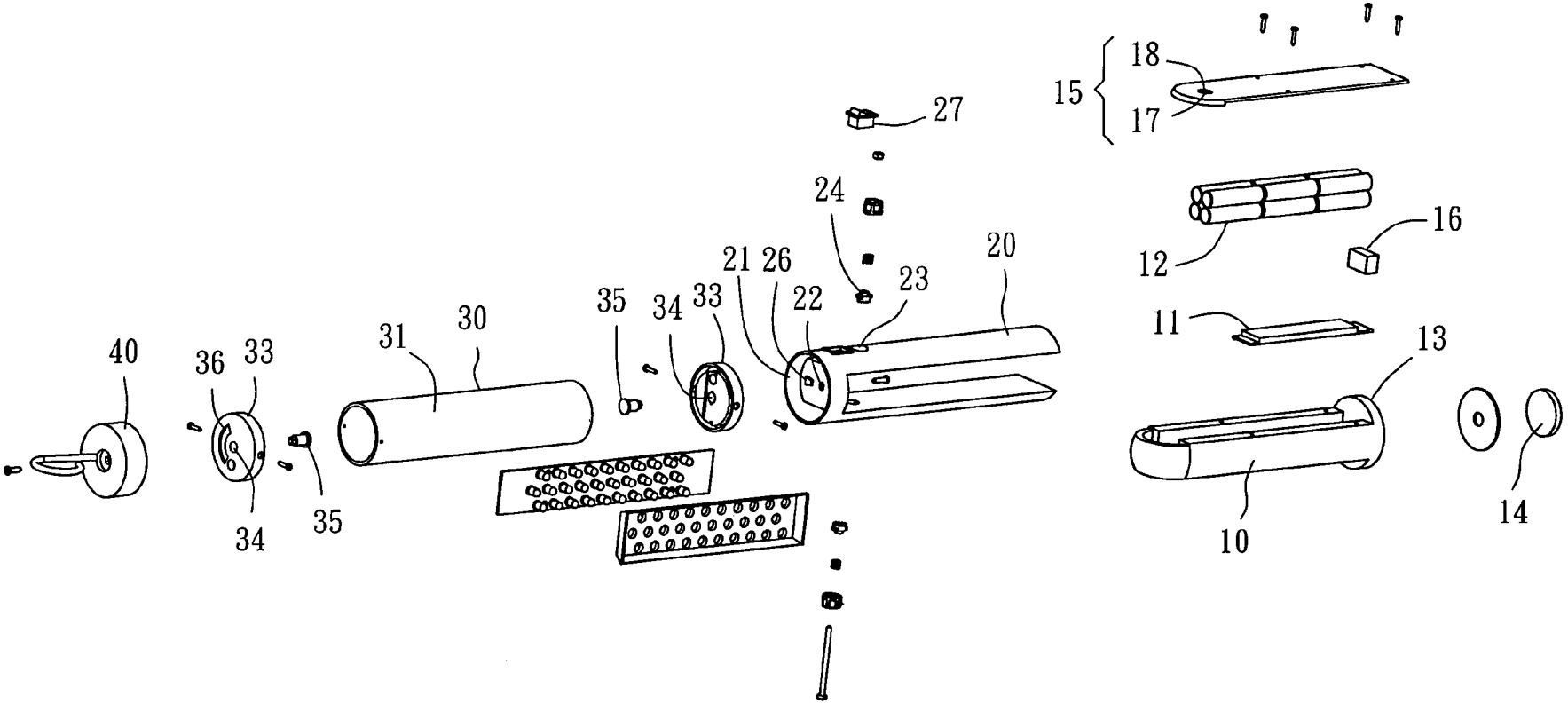
FIG. 1 and FIG. 2 are exploded views of a preferred embodiment the present invention.
Figure 2:
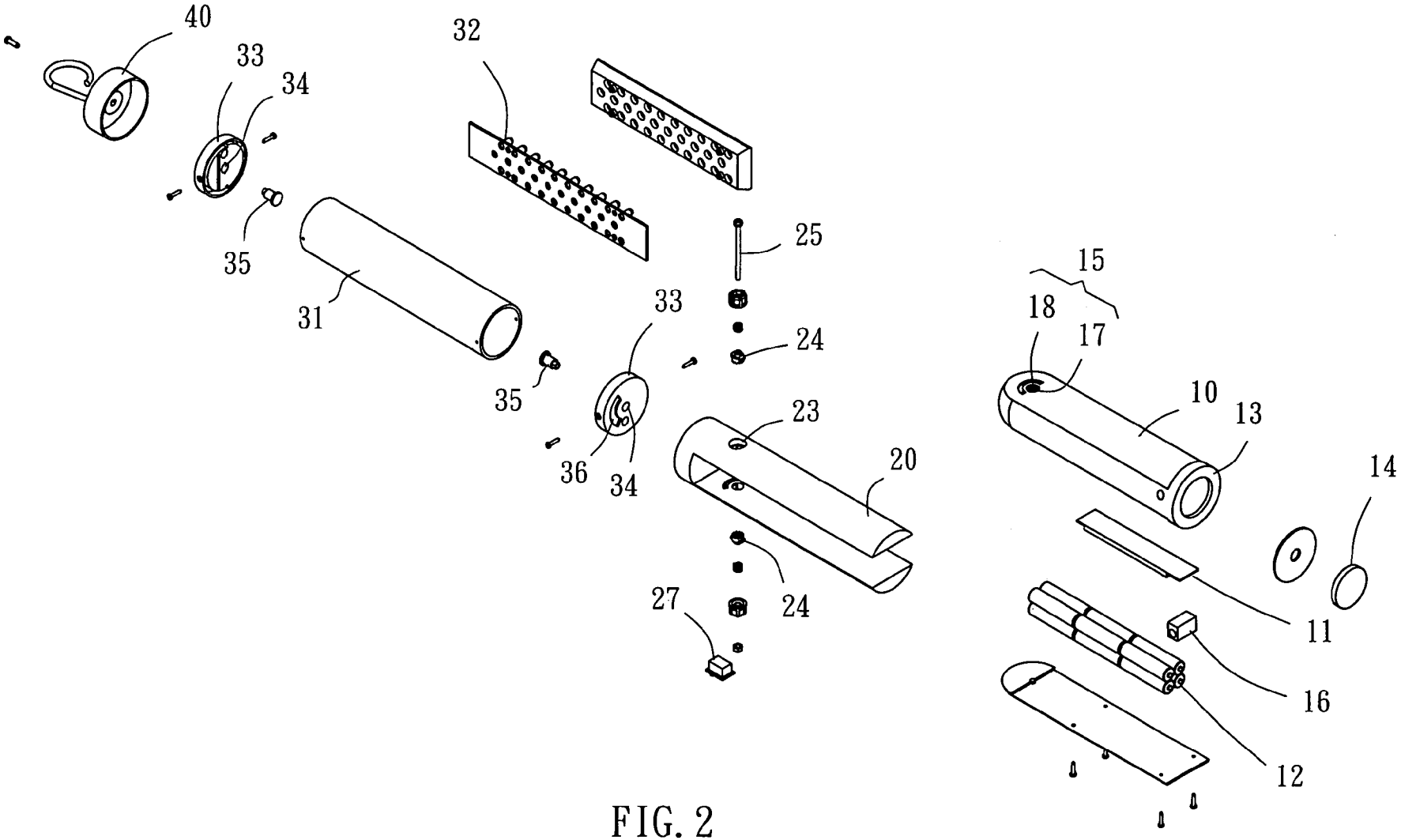
Figure 3:
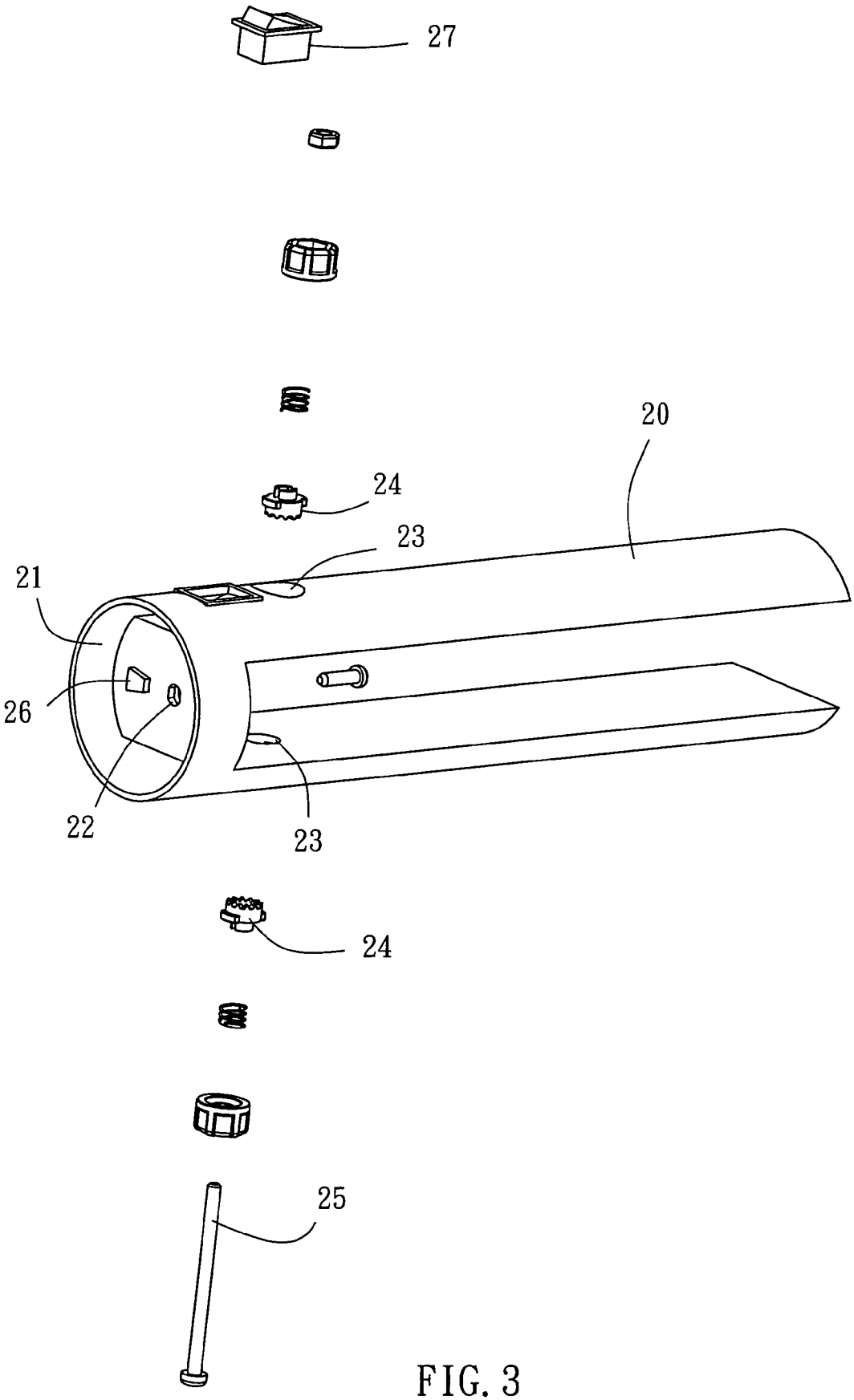
FIG. 3 is an exploded view of the pivot base of the preferred embodiment the present invention.
Figure 4:
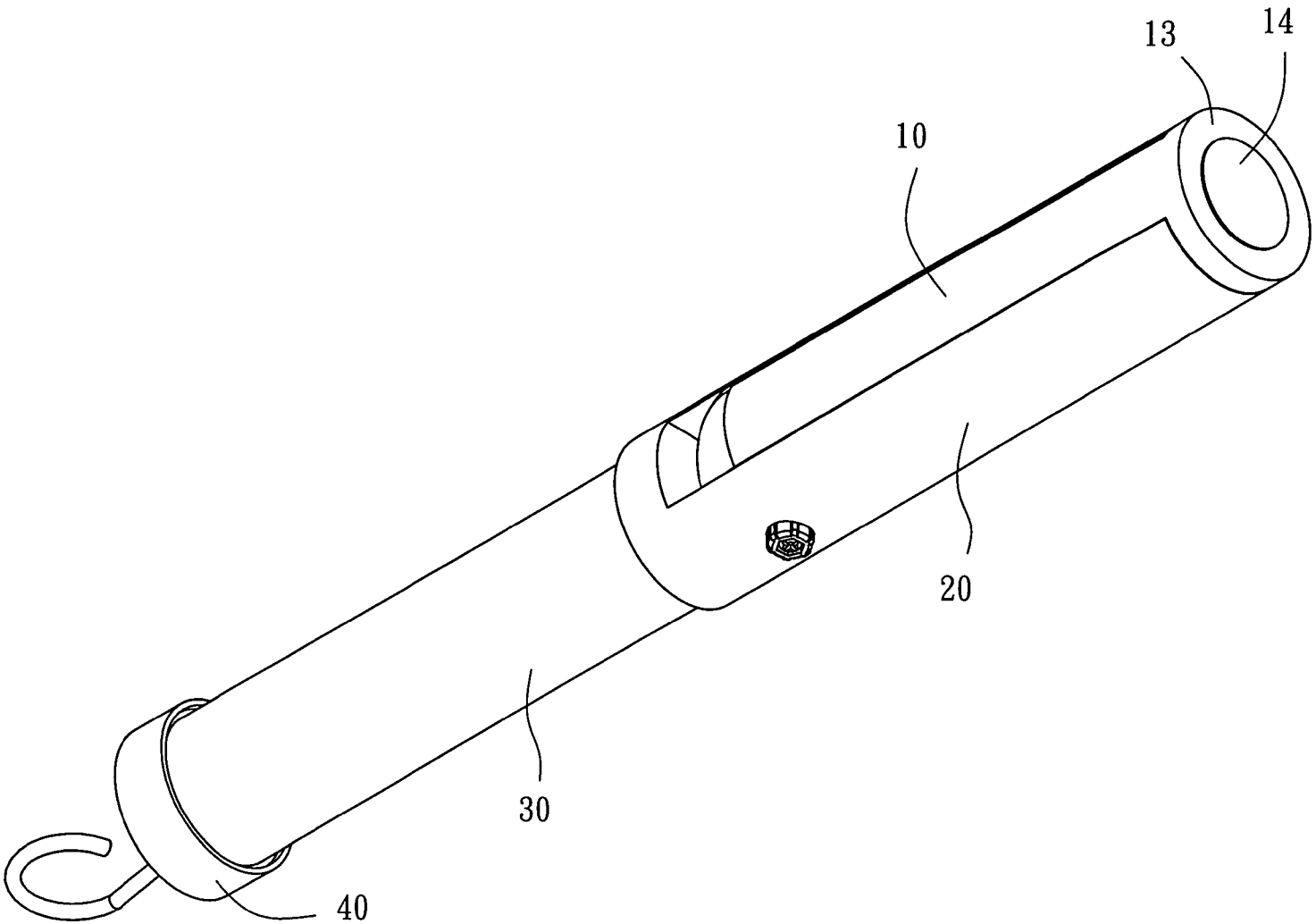
FIG. 4 is a perspective view of the preferred embodiment of the present invention.

As shown in FIG. 1 to FIG. 4, an adjustable light of the preferred embodiment of the present invention comprises:

A base member 10, which is a shell-like element, has a circuit board 11 and a battery set 12 therein to supply the power. The base member 10 has a plate portion 13 at an end thereof with a recess portion and a magnet 14 mounted in the recess portion. The base member 10 is mounted on a surface made of magnetic attraction material, such as an iron desk, by the plate portion 13 attracted on the surface. The base member 10 has a pivot portion 15 at an end thereof. In the embodiment, the base member 10 is provided with a DC socket 16 that the light of the present invention can work by DC power or battery. The pivot portion 15 has two annular teeth portions 17 at opposite sides of the base member 10, each of which encloses a through hole 18.

A pivot base 20 is pivoted on the pivot portion 15 of the base member 10, which has a chamber 21 and an opening 22 at an end thereof. In the embodiment, the pivot base 20 is a U-shaped member having two bores 23 and teeth 24 on sidewalls of the bores 23. A bolt 25 is inserted into the bores 23 of the pivot base 20 and the through hole 18 of the base member 10. As a result, the pivot base 20 is pivoted on the base member 10. With the engagement of the teeth 24 and the annular teeth portions 17, the pivot base 20 can be fixed at any desired angle. A locker 26 is provided in the chamber 21 of the pivot base 20. The pivot base 20 further is provided with a switch 27.

An illuminating tube member 30 has a transparent tube 31, in which a lamp 32 is provided. The lamp may be fluorescent lamp or light emitting diode (LED). The tube 31 is provided with two lids 33 to close ends thereof, each of which has a bore 34 at a center. A shaft 35 is inserted into the bore 34 of one lid 33 of the tube 31 to pivot the illuminating tube member 30 in the chamber 21 of the pivot base 20. A shaft 35 is inserted into the bore 34 of the other lid 33, and a hook mount 40 is pivoted on a distal end of the shaft 35. In the embodiment, each of the lids 33 of the illuminating tube member 30 is provided with a curved slot 36, which has a center of curvature at the center of the lid 33. As a result, the illuminating tube member 30 is turned relative to the pivot base 20, and the engagement of the locker 26 and the curved slot 36 can limit the turning angle of the illuminating tube member 30.

Figure 5:
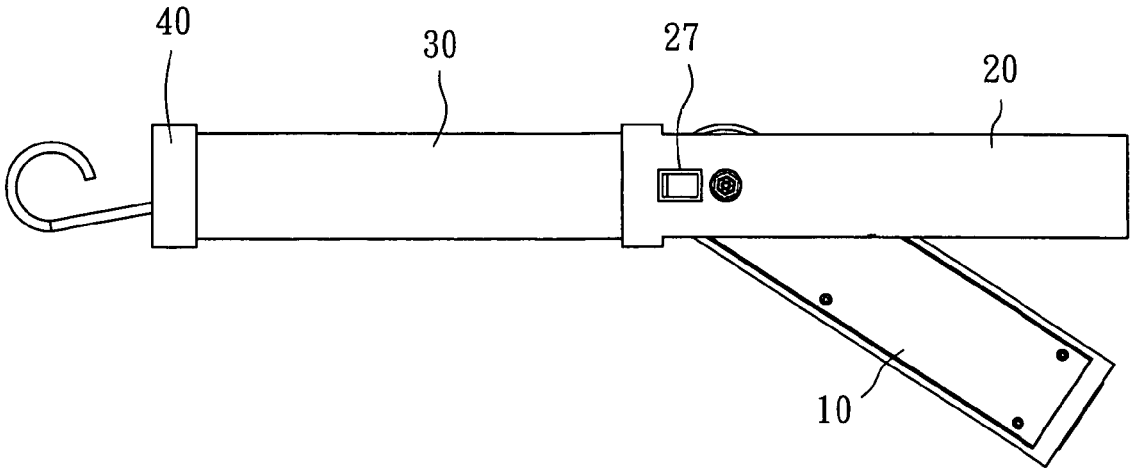
FIG. 5 is a sketch diagram of the preferred embodiment of the present invention in operation.
Figure 6:
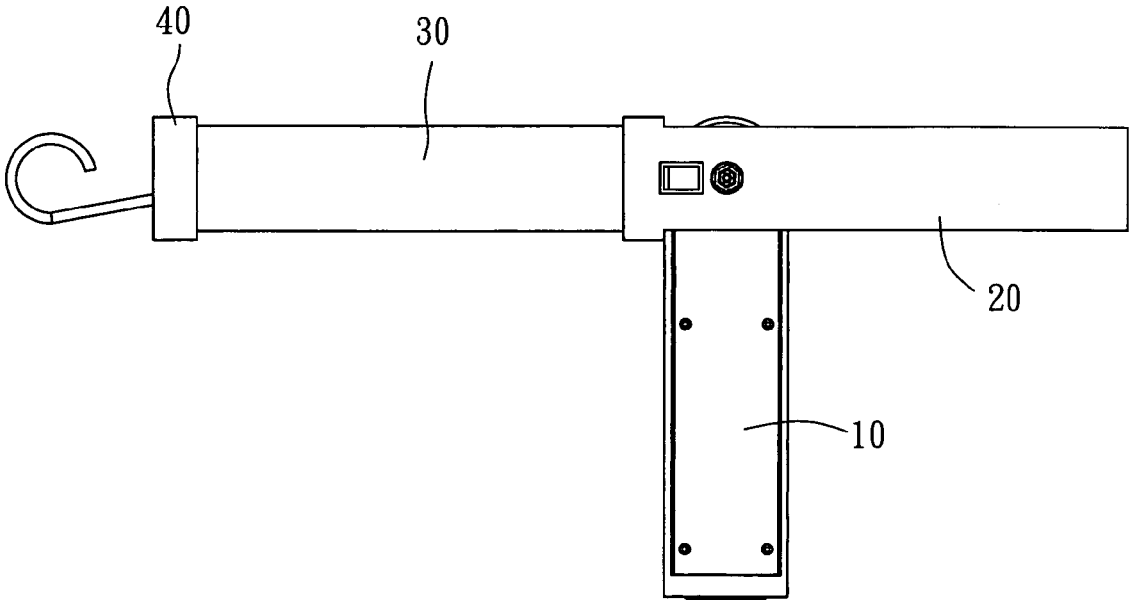
FIG. 6 is another sketch diagram of the preferred embodiment of the present invention in operation.
Figure 7:
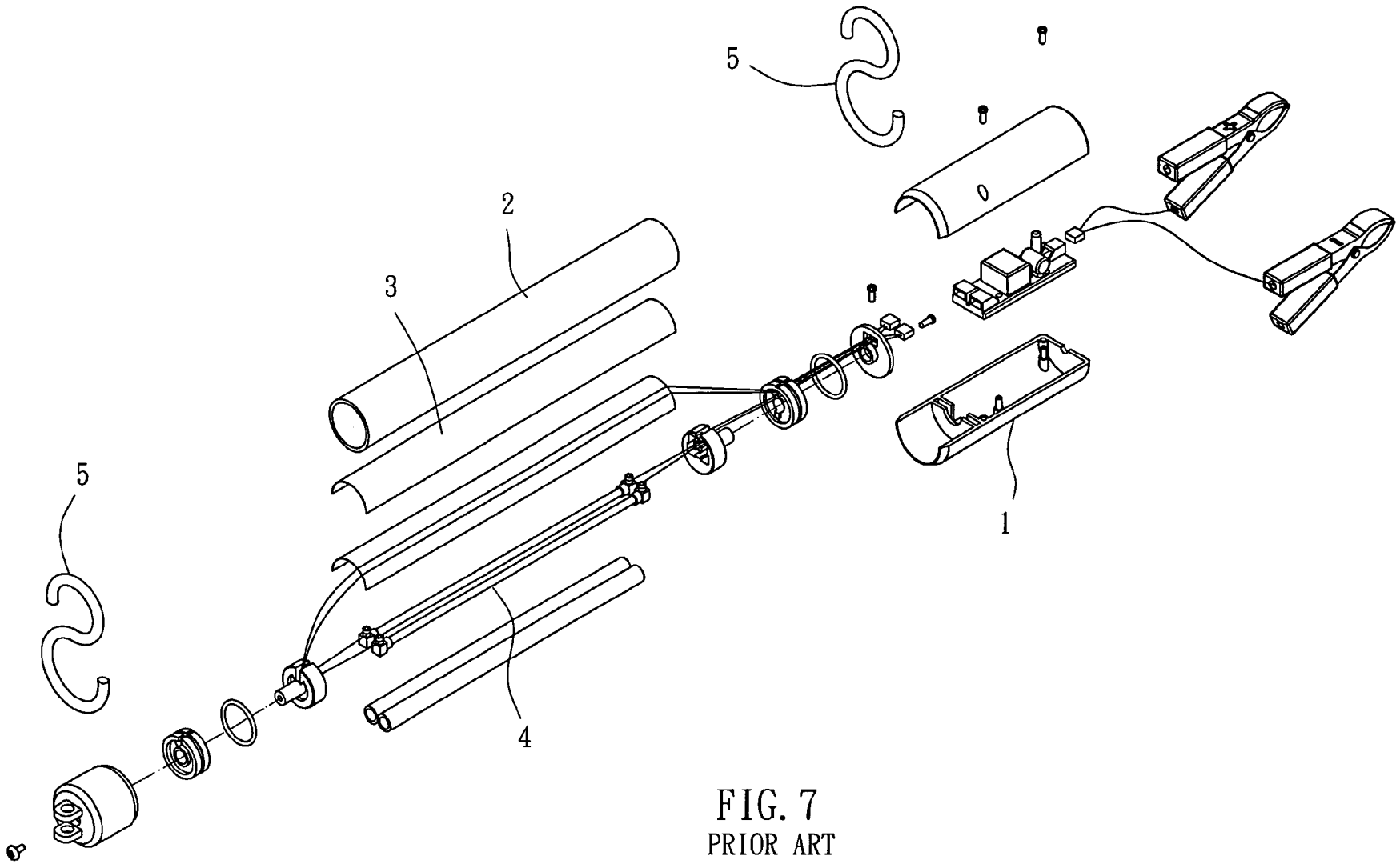
FIG. 7 PRIOR ART
FIG. 7 is an exploded view of the conventional light of the prior art.
Figure 8:
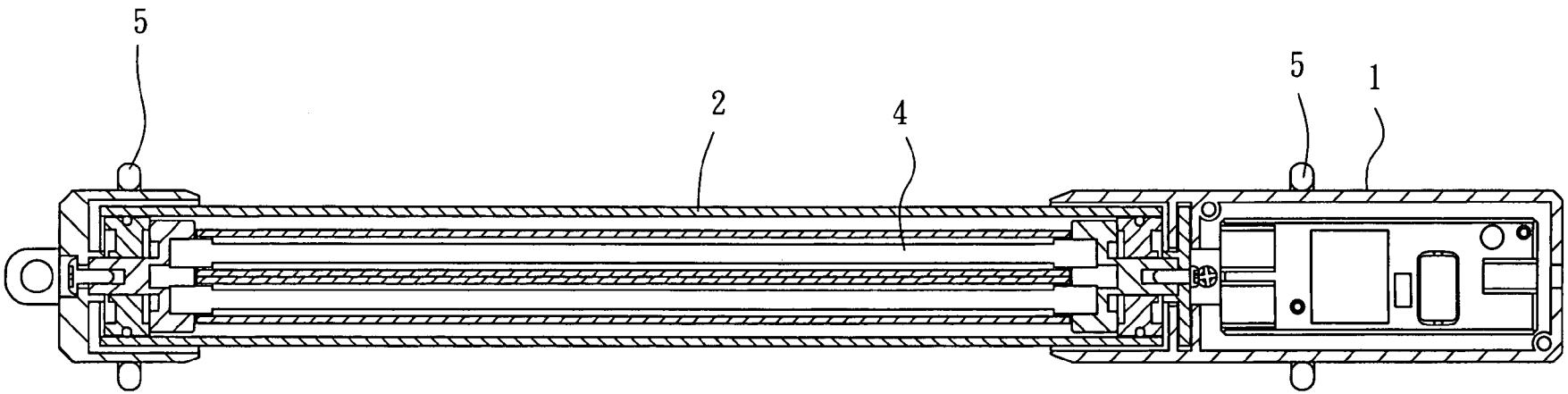
FIG. 8 PRIOR ART
FIG. 8 is a sectional view of the conventional light of the prior art.

To use the light of the present invention, user may hang the light on desired place like the conventional light used in the repairing workplace for illumination and turn the illuminating tube member 30 to a desired angle for better illumination. User may put the base member 10 on an iron plate, such as the car hood, and turn the illuminating tube member 30 to change the illuminating direction, as shown in FIG. 5 and FIG. 6, to adjust the illuminating region. The present invention provides a convenient illuminating and operating way.

What is claimed is:

1. An adjustable light, comprising:

a base member, which is a shell-like member, having a circuit board and a battery set therein, a first end of the base member having a pivot portion and a second free end of the base member having a magnet, wherein the magnet can be attracted on a surface, which is made of a magnetic attraction material, the pivot portion having two annular teeth portions fixed on opposite sides of the base member, and each of the annular teeth portions enclosing a through hole;

a pivot base pivoted on the pivot portion of the base member, the pivot base having two bores at opposite sides with teeth fixed on sidewalls thereof and a bolt inserted into the bores of the pivot base and the through hole of the base member, whereby the teeth are engaged in a plane with the annular teeth portions to adjust the axis of the pivot base at a desired angle relative to the axis of the base member;

wherein the pivot base has a switch thereon and a chamber at an end thereof having an opening and a locker therein;

an illuminating tube member having a transparent tube and a lamp fixed in the tube, wherein the tube has a first lid and second lid fixed to opposite ends thereof to close the tube, wherein the first lid has a bore through which a shaft is inserted into the opening of the pivot base so as to engage the first lid in the chamber of the pivot base and fix the illuminating tube member on the pivot base so that the axes of the tube member and the pivot base are coaxial;

wherein the first lid has a curved slot with a center of curvature on the axis of the tube member and the locker is engaged in the curved slot so that the illuminating tube member is pivotable around the axis of the tube member and the locker limits a turning angle of the illuminating tube member around the axis thereof, and wherein a hook mount is pivotally engaged on the second lid.

2. The adjustable light as defined in claim 1, wherein the base member has a plate portion with a recess portion, wherein the magnet is engaged in the recess portion.

3. The adjustable light as defined in claim 1, wherein the base member is provided with a DC socket.

* * * * *